United States Patent [19]

Bueker

[11] 4,027,872

[45] June 7, 1977

[54] SHEET SEPARATION DEVICE

[75] Inventor: Robert A. Bueker, Mission Viejo, Calif.

[73] Assignee: Direct Image Corporation, Monterey Park, Calif.

[22] Filed: Jan. 15, 1976

[21] Appl. No.: 649,394

[52] U.S. Cl. ..... 271/170; 271/20; 271/104

[51] Int. Cl.[2] ..... B65H 3/54

[58] Field of Search ..... 271/19, 20, 104, 170; 267/154

[56] References Cited

UNITED STATES PATENTS

| | | | |
|---|---|---|---|
| 1,493,167 | 5/1924 | Stevens | 271/20 |
| 2,100,057 | 11/1937 | Krebs | 267/154 |
| 3,403,903 | 10/1968 | Crail | 271/104 X |

*Primary Examiner*—Robert W. Saifer

*Attorney, Agent, or Firm*—Nilsson, Robbins, Dalgarn & Berliner

[57] ABSTRACT

A sheet separation device is disclosed for use in a printing press to facilitate the removal of individual paper sheets from a stack to receive printing. The device is employed in cooperation with a supported stack of paper and a contiguous apparatus for lifting sheets from the stack, as for delivery to a printing station. The sheet separation device includes a bracket affixed to the paper supporting structure and defining an elongated spring chamber which extends parallel to the surface of paper in the stack. A torsion or coil spring is affixed to dwell in the spring chamber. A tab is affixed to the spring and incorporates a flat section which extends parallel to the sheets in the stack of paper. The spring-mounted tab permits the withdrawal of a single sheet from the stack, however, impedes the withdrawal of more than one sheet at a time.

5 Claims, 5 Drawing Figures

SHEET SEPARATION DEVICE

BACKGROUND AND SUMMARY OF THE INVENTION

Various forms of devices for lifting individual sheets from a stack are well known in the prior art. Generally, conventional devices may involve vacuum heads for lifting the top sheet from a stack as well as blower apparatus for improving selectivity. Additionally, conventional systems also employ structures that are sometimes referred to as "Cat's Whiskers" or retainers which contact the stack of paper at locations adjacent one edge and release the top sheet on a stack while retaining the second sheet. Conventionally, cat's whiskers or sheet retainers have taken the form of leaf spring devices which forcefully engage the stack of sheets, however, yield to release the top sheet from the stack. Although such structures operate effectively under ideal conditions, maintaining the desirable spring force is frequently a problem. Consequently, some substantial amount of time is expended in adjusting the replacing these sheet retainers. Accordingly, an improved retainer for use as a sheet separator was developed as disclosed in U.S. Pat. No. 3,403,903. However, a need continues for a simpler, more rugged mechanism.

In general, the present invention incorporates a retainer (cat's whisker) for use in combination with the components of a sheet delivery system, which retainer includes a bracket that may be affixed to the mechanism at a location contiguous to the stack from which sheets are delivered. The bracket defines an elongate chamber which contains a torsion spring with stationary anchored ends and which supports a tab to dwell in flat facing contact with the top sheet of the stack so as to yieldably release the sheet and immediately thereafter engage the next sheet, retaining it until the time of the next sheet delivery.

Systems incorporating retainers in accordance with the present invention may be economically manufactured and are capable of effective operation for extended periods with relatively little adjustment. As will be apparent from the complete presentation as set forth below, the retainers are capable of economical manufacture and simple installation.

BRIEF DESCRIPTION OF THE DRAWINGS

The drawings, disclosing an illustrative embodiment of the invention to present the various advantages and objects hereof, are as follows.

DESCRIPTION OF THE ILLUSTRATIVE EMBODIMENT

As indicated above, a detailed illustrative embodiment of the invention is disclosed herein. However, embodiments may be constructed in accordance with various other forms, some of which may be rather different from the disclosed illustrative embodiment herein. Consequently, the specific structural and functional details disclosed herein are more representative, yet in that regard they are deemed to provide the best embodiment for purposes of disclosure and to establish a foundation as the basis for the claims herein which define the scope of the present invention.

Figure 1:
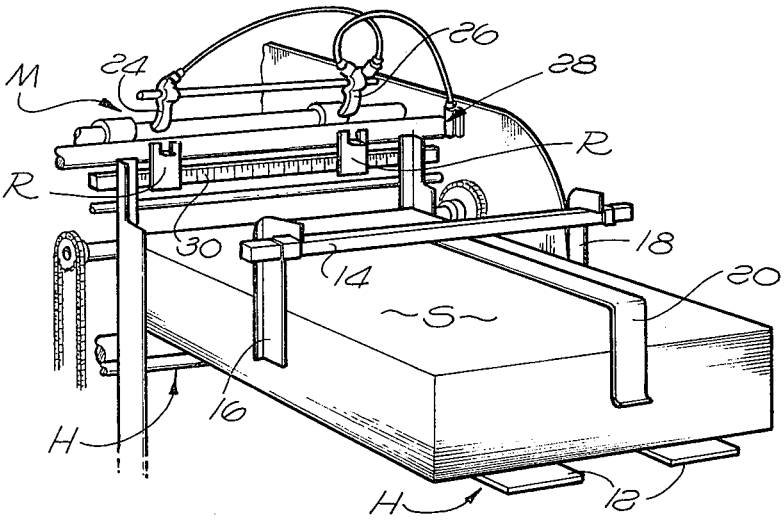
FIG. 1 is a perspective view of a portion of a printing press incorporating retainers of the present invention.

Referring initially to FIG. 1, a portion of a printing press is depicted showing a stack S of paper from which individual sheets are to be drawn. The stack S is supported with the sheets in alignment by a support structure generally indicated as H. As individual sheets are removed from the stack S, the support H raises the stack progressively. Selective removal of sheets (S1, S2, and so on) from the stack S is performed by a composite mechanism generally indicated at M as will be described in somewhat greater detail below along with the retainer devices R.

Purusing the total mechanical system, the stack S rests on the support H which includes a plurality of individual beams 12. Alignment guides 16 and 18 are supported at the sides of the stack S and a similar guide 20 is provided at the rear end as depicted. As indicated above, the support H is raised progressively, specifically by a lifting mechanism M, so that the mechanism M operates essentially in a single plane.

The mechanism 20 incorporates a pair of vacuum heads 24 and 26 which are connected to a source of partial vacuum and which move through a pattern controlled by the mechanism M to cyclically lift the top sheet from the stack S. In that regard, it is to be understood that the heads 24 and 26 drop from the position depicted (FIG. 1) to contact the top sheet S1 of the stack S lifting it from the stack. The selection of the top sheet S1 may also be assisted by a pneumatic structure (not shown) which directs air currents to assist in individual sheet removal. The retention of the second sheet S2 in the stack during the removal of the first sheet S1 is accomplished by the retainer devices R which will now be considered in detail.

Figure 2:
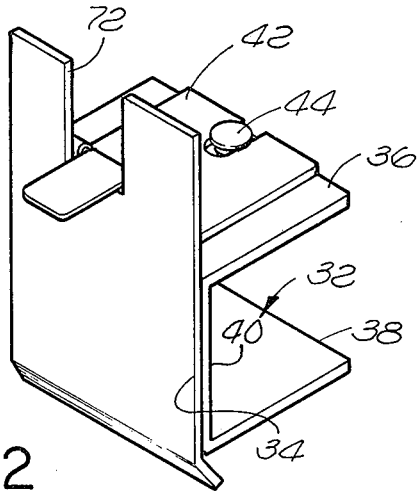
FIG. 2 is a perspective view of an enlarged component of the structure of FIG. 1.

A lateral bar 30 is supported to extend adjacent the internal end of the stack S as depicted in FIG. 1. The bar 30 supports the retainer devices R which are illustrated in greater detail in FIG. 2 to which reference will now be made.

The substantially identical retainer devices R include a U-shaped yoke 32 (FIG. 2) which is fitted on the bar 30 (FIG. 1) and is affixed to a flat plate 34 (FIG. 2) so that spaced-apart legs 36 and 38 of the yoke 32 extend perpendicularly to the plate 34 and a central section 40 of the yoke. The retainer devices R (FIG. 1) are supported on the bar 30 which is friction fitted in the yoke 32.

Functionally, the retainer devices R as described above serve to support the actual "cat's whiskers" or retainers 42 (FIG. 2) constructed in accordance with the present invention. A retainer 42 is affixed to the leg 36 of each retainer device R by a stud 44.

Figure 3:
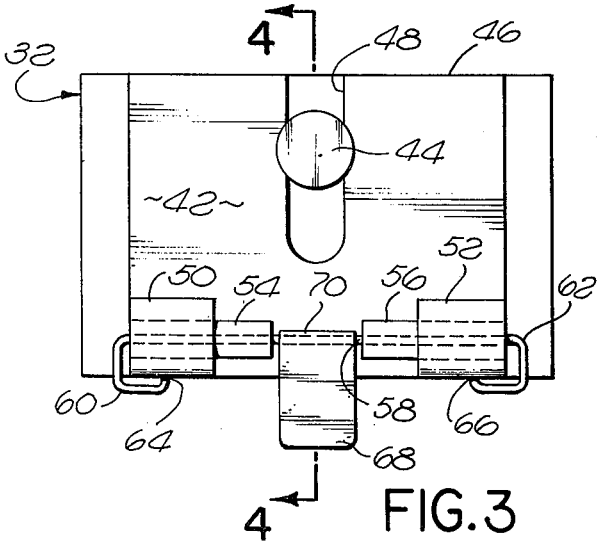
FIG. 3 is a further enlarged plan view of a portion of the structure of FIG. 2.
Figure 4:
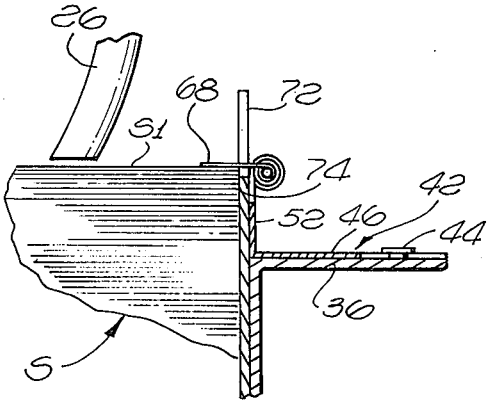
FIG. 4 is a sectional view taken along line 4—4 of FIG. 3.

Considering the retainer 42 in greater detail, reference will now be made to FIGS. 3 and 4 somewhat concurrently. A base bracket 46 defines a slot 48 (FIG. 3) for receiving the stud 44 to position the retainer 42. Generally, the bracket 46 is of thin sheet metal stock having a rectangular configuration so as to lie in flat facing engagement with the bracket leg 36 (FIG. 4). At the side of the bracket 46, which is opposed to the slot 48, the bracket extends perpendicularly in a pair of spaced-apart extensions 50 and 52 (FIGS. 3 and 4)

which are turned back to circle and retain a pair of spacers 54 and 56 in concentric alignment. Thus, the spacers 54 and 56 are set or attached in the bracket 46 so as to define a discontinuous elongate chamber which receives a torsion spring 58. The opposed ends 60 and 62 of the spring 58 extend outwardly from the spacers 54 and 56 and are turned back for stationary locking in holes 64 and 66, respectively, defined in the extensions 50 and 52. Thus, the spring 58 is locked within the centrally-open chamber defined by the spacers 54 and 56.

At the center of the spring 58, a tab 68 is locked in position. Specifically, tab 68 is of flat stock with one end 70 looped and clamped to the spring 58. Consequently, the flat portion of tab 68 extends in a plane substantially parallel to the bracket 46 (FIG. 4) passing through a space 72 (FIG. 2) defined in the plate 34 so as to dwell above the end 74 of the paper stack S. Furthermore, as the tab 68 is affixed to the spring 58 (in the position depicted in FIG. 4) the spring 58 provides a slight downward bias to the tab 68. Accordingly, the tab 68 engages the top sheet S1 of the stack S with a firm but yieldable force.

In the manufacture of the retainer 42, relatively simple techniques may be employed. Generally, the bracket 46 may be formed of brass or aluminum hinge stock with the raised extensions 50 and 52 terminated in loops to receive the spacers 54 and 56, respectively, which may comprise short sections of tubular stock. In assembly, the spacers 54 and 56 are telescopically fitted into the aligned spaces defined by the extensions 50 and 52. Next, the torsion spring 58 is concentrically fitted into the spacers 54 and 56 and the ends of the spring are hooked into the bracket holes 64 and 66 as indicated (FIG. 3). Finally, the tab 68 which may be formed of brass sheet stock and is of some .05 square inch in size, is fitted over the spring and crimped tightly onto the spring. The retainer 42 is affixed by engagement with a stud 44 to provide a complete retainer device R.

Figure 5:
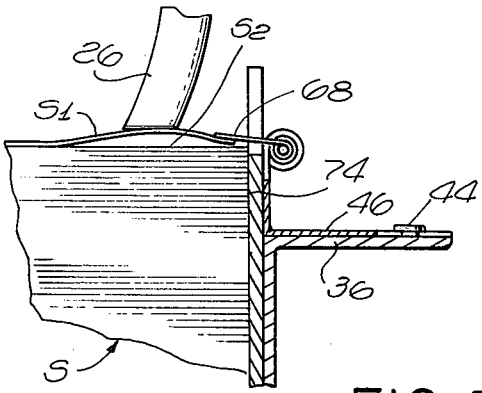
FIG. 5 is a view similar to FIG. 4 showing the components in another operating configuration.

Considering the operation of the retainer 42, reference will now be made to FIGS. 4 and 5. As indicated above, individual sheets are to be drawn from the stack S by vacuum heads, e.g. head 26 (FIG. 1). As indicated in FIG. 4, the illustrated head 26 is moved to a position contiguous to the top sheet S1 of the stack S and as a result of the vacuum within the head 26 the top sheet S1 is lifted from the stack S as illustrated in FIG. 5. As the sheet S1 is lifted, the tab 68, at the edge of the stack S, yields (with the flexures of the internal torsion spring 58) to the point at which the sheet S1 is released by moving above the tab 68 (not illustrated). Thereupon, the tab 68 immediately drops back into position parallel with the sheets of the stack S (FIG. 4) so as to retain the next sheet of the stack. The cyclic operation is then repeated to release single sheets in sequence from the stack S for processing.

In the operation of the retainers 42, extended periods of service can be anticipated with little adjustment or modification. Of course, replacement may be necessary after extended intervals of use; however, the periods of reliable service will be considerably prolonged over leaf spring devices of conventional structure. Also, construction of the unit is simple as the ends of the torsion spring are mechanically fixed or anchored to avoid movement.

As indicated above, the embodiment described herein is deemed best for the purposes hereof; however, recognizing various modifications are apparent, the scope hereof shall be deemed to be defined by the claims as set forth below.

What is claimed is:

1. A sheet separation device for use with a stack of sheets held by a support structure for individual sheet removal by a lifting mechanism, comprising:

a bracket member affixed to said support structure and defining spaced-apart, axially aligned passages adjacent to said stack of sheets;

a torsion spring having opposed ends fixed to said bracket member and extending coaxially between said aligned passages;

a pair of tubular spacers mounted in said passages to support said spring coaxially with said aligned passage and extending to substantially enclose said torsion spring on each side of a central length;

and tab means affixed to said central length of said torsion spring to provide a flat leaf section in a plane substantially parallel to said sheets, for contacting the stack at one edge thereof.

2. A sheet separator according to claim 1 wherein said support structure includes a retainer device having a stud fixed therein and wherein said bracket member of said sheet separator defines a slot to receive said stud.

3. A sheet separator according to claim 1 wherein said tab is of about 0.05 square inch in size.

4. A sheet separator according to claim 1 wherein said spring has ends thereof fixed into said bracket member.

5. A sheet separator according to claim 1 wherein said tab comprises brass sheet material.

* * * * *